US006771246B2

(12) United States Patent
Yun et al.

(10) Patent No.: US 6,771,246 B2
(45) Date of Patent: Aug. 3, 2004

(54) DATA TRANSMISSION METHOD AND APPARATUS FOR DRIVING A DISPLAY

(75) Inventors: Sang Chang Yun, Kumi-shi (KR); Sung Woong Moon, Kumi-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 128 days.

(21) Appl. No.: 09/747,931

(22) Filed: Dec. 27, 2000

(65) Prior Publication Data

US 2001/0040564 A1 Nov. 15, 2001

(30) Foreign Application Priority Data

Dec. 28, 1999 (KR) ..... P1999-63229

(51) Int. Cl.[7] ..... G09G 3/36; G09G 5/00

(52) U.S. Cl. ..... 345/98; 345/87; 345/90; 345/98; 345/204

(58) Field of Search ..... 345/204–206, 345/87, 98, 99–100, 90, 93

(56) References Cited

U.S. PATENT DOCUMENTS

| | | | | |
|---|---|---|---|---|
| 5,748,902 A | | 5/1998 | Dalton et al. | |
| 5,856,816 A | | 1/1999 | Youn | |
| 5,917,364 A | | 6/1999 | Nakamura | |
| 6,335,718 B1 | | 1/2002 | Hong et al. | |
| 6,348,915 B1 | * | 2/2002 | Yamashita et al. | 345/204 |
| 6,356,260 B1 | * | 3/2002 | Montalbo | 345/100 |

FOREIGN PATENT DOCUMENTS

| | | |
|---|---|---|
| EP | 0069183 | 1/1983 |
| EP | 0228528 | 7/1987 |
| JP | 04-303234 | 10/1992 |
| JP | 05-334206 | 12/1993 |
| JP | 08-8991 | 1/1996 |
| JP | 09-233146 | 9/1997 |
| JP | 10-190751 | 7/1998 |
| WO | WO-92/09162 | 5/1992 |
| WO | WO-97/13347 | 4/1997 |
| WO | WO-97/13348 | 4/1997 |

OTHER PUBLICATIONS

Crystal, A Cirrus Logic Company, Flat Panel Electronics—EMI Reduction Features DTR Block Diagram.

* cited by examiner

*Primary Examiner*—Regina Liang
*Assistant Examiner*—Duc Q. Dinh
(74) *Attorney, Agent, or Firm*—McKenna Long & Aldridge

(57) ABSTRACT

A data transmission method and apparatus that is adaptive for minimizing the power consumption and the electromagnetic interference. A bit data to be transmitted is delayed during at least one bit interval. The bit data to be transmitted is substituted by an identity to the delayed bit data. The identity is transmitted to a transmission line.

22 Claims, 3 Drawing Sheets

DATA TRANSMISSION METHOD AND APPARATUS FOR DRIVING A DISPLAY

This application claims the benefit of Korean Patent Application No. P99-63229, filed on Dec. 28, 1999, which is hereby incorporated by reference for all purposes as if fully set forth herein.

BACKGROUND OF THE INVENTION

1. Field of the Invention

The present invention relates to a data transmission method and apparatus, and more particularly to a liquid crystal display employing the data transmission apparatus. Also, the present invention is directed to a computer system employing the data transmission apparatus. Furthermore, the present invention is directed to a data driver integrated circuit for a liquid crystal panel that is adapted for minimizing an electromagnetic interference at a transmission line.

2. Discussion of the Related Art

Generally, the amount of information, transmitted over a transmission medium such as text information and video information, has been increased in comparison to audio information. Recently, the amount of the video information has been increased more and more so as to meet user needs for a high quality image. In addition, recently information has been transmitted at a high speed so that a user can make use of the information at an appropriate time. For these reasons, a frequency band occupied by the information signal must be increased and, simultaneously, the number of lines for transmitting the information must be increased, depending on the amount of information.

For example, in a data line driving apparatus shown in FIG. 1, video data transmitted from a controller 10 to a data drive integrated circuit chip 12, hereinafter referred to as "D-IC", including a shift register array 20 and a digital to analog converter 22, has a higher frequency as the resolution mode of a picture becomes higher, that is, as the number of pixels on a liquid crystal panel becomes larger. More specifically, since more pixels are contained in the liquid crystal panel when the resolution mode of a picture is changed from the VGA mode to the XGA or SXGA mode, an amount of video data for one line transmitted in one horizontal period is increased. Thus, the frequency of video data transmitted from the controller 10, via a data bus 11, to the D-IC 12 becomes high. As the frequency of video data becomes high, a serious electromagnetic interference (EMI) is generated at the data bus 11 for successively transmitting 18 bit data (e.g., R, G and B data having 6 bits each) for one pixel from the controller 10 to the D-IC 12.

In addition, as the frequency of the video data becomes high, the controller 10 must switch a high logic voltage and a low logic voltage at a high speed. Due to this, the controller 10 transmitting data to the data bus 11 has large power consumption, as the frequency of a video data increases.

Likewise, the EMI and the large power consumption as mentioned above are also generated by a data transmission system between a graphic card within a computer main body and a liquid crystal display device (i.e., a controller 10 in FIG. 1).

SUMMARY OF THE INVENTION

Accordingly, it is desired to provide a data transmission method and apparatus that is adapted for minimizing the power consumption and the electromagnetic interference that substantially obviates one or more of the problems due to limitations and disadvantages of the related art.

It is also desired to provide a data reception method and apparatus that is adaptive for minimizing the power consumption and the electromagnetic interference.

In order to achieve these and other objects of the invention, a method of transmitting pixel data for a display according to one aspect of the present invention, comprises generating from the pixel data pixel representation data having a frequency of bit transitions which is less than a frequency of bit transitions of said pixel data; transmitting the pixel representation data along a data bus; receiving from said data bus the pixel representation data; reconstructing the pixel data from the pixel representation data; and supplying the pixel data to the display.

A data transmission apparatus according to another aspect of the present invention includes a controller supplying pixel data comprising a plurality of bits; a data substitution unit receiving the pixel data and transmitting pixel representation data having a frequency of bit transitions which is less than a frequency of bit transitions of said pixel data; and a data driver integrated circuit connected to said data substitution unit and receiving the pixel representation data via a data bus, reconstructing the pixel data, converting the pixel data to analog pixel data, and supplying the analog pixel data to the display.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiment of the present invention, example of which is illustrated in the accompanying drawings.

Figure 1:
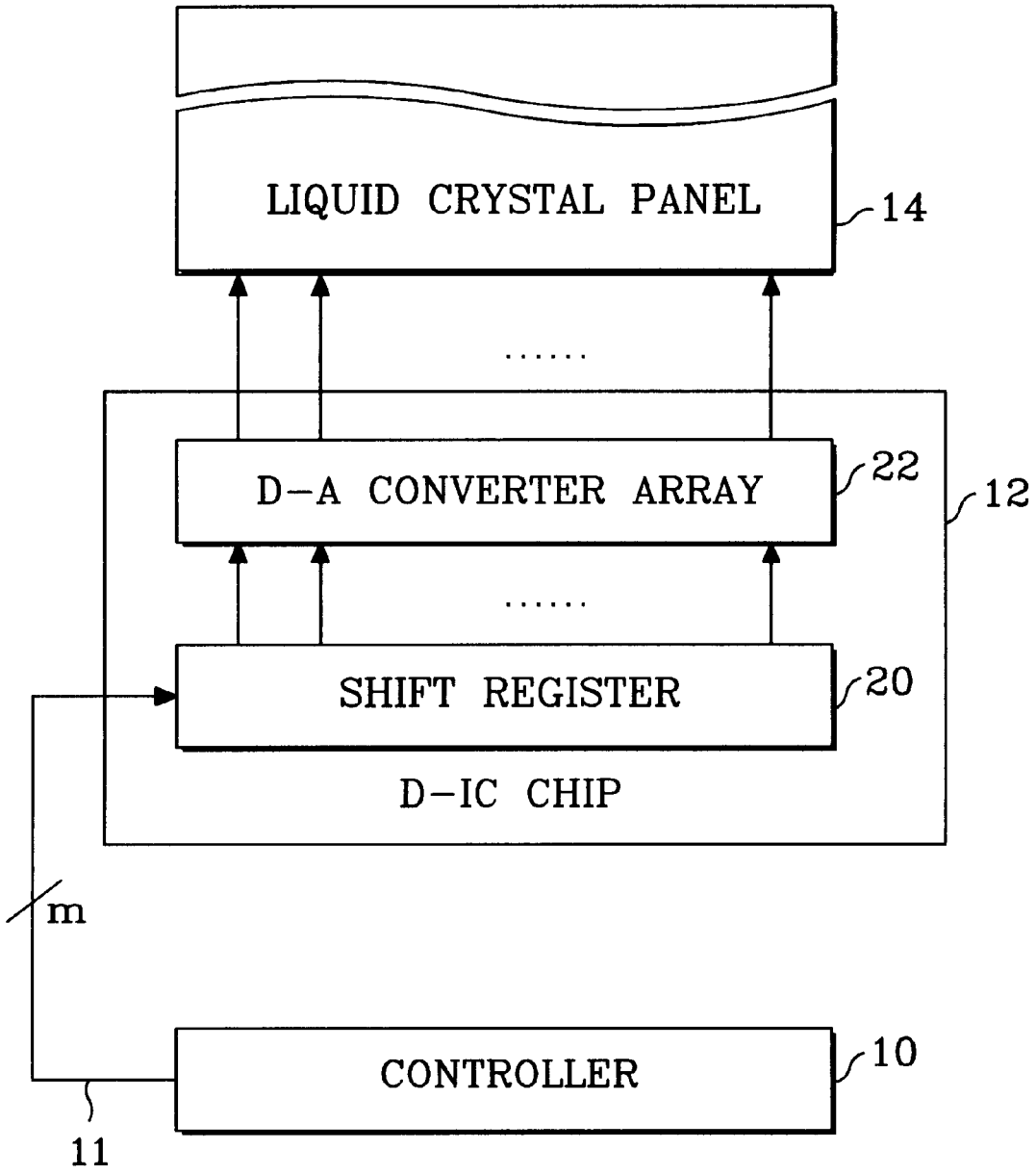
FIG. 1 CONVENTIONAL ART
FIG. 1 is a block diagram showing the configuration of a liquid crystal display driver to which the conventional data transmission method is applied.
Figure 2:
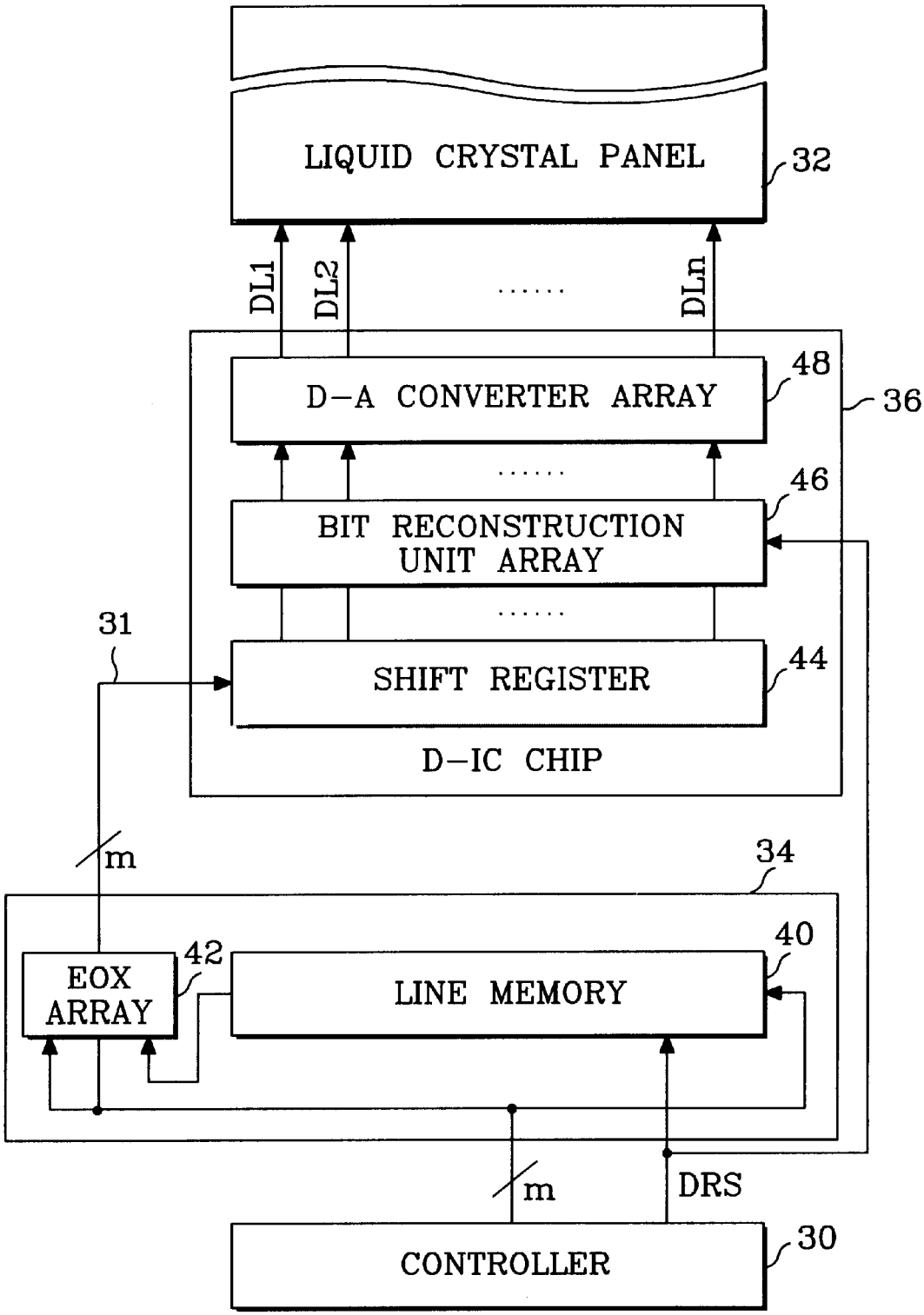
FIG. 2 is a block diagram showing the configuration of a liquid crystal display driver to which a data transmission system according to an embodiment of the present invention is applied.

Referring to FIG. 2, there is shown a data driver for a liquid crystal panel according to an embodiment of the present invention. The data driver includes a data substitution unit 34 and a D-IC chip 36 connected, in series, between a controller 30 and a liquid crystal panel 32. The controller 30 successively supplies the data substitution unit 34 with m-bit pixel data. The m-bit pixel data includes red (R) pixel data, green (G) pixel data and blue (B) pixel data. When pixel data has 18-bits, each of the R, G and B data has 6-bits. The controller 30 applies a data reset signal DRS to the data substitution unit 34 and the D-IC chip 36. The data reset signal DRS is enabled to a specific logical value (e.g., high or low logic value) in a certain time interval when power is turned on, or is enabled to a specific logical value in a certain time interval whenever pixel data for one picture are transmitted. Also, the controller 30 applies a clock signal indicating a transmission frequency of a pixel data to the data substitution unit 34 and the D-IC chip 36.

For each bit, the data substitution unit 34 compares the m-bit pixel data with m-bit pixel data from the previous line. The data substitution unit 34 transmits the compared result for each bit, that is, the compared m-bit data, via the m-bit data bus 31 to the D-IC chip 30. To this end, the data substitution unit 34 includes a line memory 40 and an exclusive OR gate array 42 for commonly inputting a pixel data from the controller 30.

The line memory 40 initializes pixel data for one line stored thereto in a time interval when the data reset signal DRS from the controller 30 has a specific logical value (e.g., "0" or "1"). The line memory 40 inputs new m-bit pixel data from the controller 30 every specific edge (i.e., rising edge or falling edge) of the clock signal from the controller 30 and, at the same time, applies m-bit pixel data input during a transmission interval for a prior line to the exclusive OR gate array 42. In other words, the line memory 40 may be a shift register having a storage capacity able to store pixel data for one line.

The exclusive OR gate array 42 consists of m exclusive OR gates. The m exclusive OR gates distributively receive m-bit pixel data for the current line from the controller 30 and, at the same time, distributively receive m-bit pixel data for the previous line from the line memory 40. Also, each of the m exclusive OR gates checks whether or not the bit pixel data for the current line is identical to the bit pixel data for the previous line. If both bit pixel data are same, then each exclusive OR gate delivers the compared bit data having a logical value of "0", via the data bus 31, to the D-IC chip 36. Otherwise, if both bit pixel data have a different logical value, then each exclusive OR gate delivers the compared bit data having a logical value of "1", via the data bus 31, to the D-IC chip 36.

Accordingly, the compared bit data has a logical value of "0" continuously while a logical value of "1" intermittently due to a characteristic of a picture that pixels having the same gray level value appear continuously in the vertical and horizontal direction. As a result, the frequency of the compared bit data is dramatically reduced compared to the original pixel data.

The D-IC chip 36 sequentially inputs m-bits of compared data for one line from the data bus 31, and reconstructs pixel data for one line from the compared bit data for one line. The D-IC chip 36 also converts the pixel data for one line into analog pixel signals to apply the converted analog pixel signals for one line to n data lines DL1 to DLn of the liquid crystal panel 32. To this end, the D-IC chip 36 includes a shift register 44, a bit reconstruction unit array 46 and a digital to analog converter array 48 that are connected between the data bus 31 and the liquid crystal panel 32 in cascade.

The shift register 44 inputs the m-bit compared data by from the data bus 31 on every specific edge (i.e., rising edge or falling edge) of the clock signal from the controller 30 to shift the same to the right. The shift register 44 applies the compared bit data for one line inputted thereto to the bit reconstruction unit array 46.

The bit reconstruction unit array 46 includes data substitution units equal to the number of bits, e.g., $(m \cdot n)/3$, of the compared bit data for one line. Each of these bit reconstruction units selectively inverts the pixel bit data stored previously in accordance with a logical value of the compared bit data from the shift register 44 to reconstruct the pixel bit data. More specifically, if a logical value of the compared bit data is "0," then the corresponding bit reconstruction unit transmits the previously stored pixel bit data (i.e., the same pixel bit data as for the previous line) to the D-A converter array 48 as the pixel bit data at the current line. On the other hand, if a logical value of the compared bit data is "1," then the corresponding bit reconstruction unit inverts the pixel bit data stored previously and transmits the inverted previously-stored pixel bit data to the D-A converter array 48 as the current pixel bit data.

The D-A converter array 48 includes D-A converters equal to the number of data lines DL1 to DLn of the liquid crystal panel 32. Each of these D-A converters inputs m pixel bit data (i.e., m-bit pixel data) from the bit reconstruction unit array 46. Each of the D-A converters converts the m-bit pixel data into an analog pixel signal and applies the converted analog pixel signal to the corresponding data line DL1 to DLn.

Figure 3:
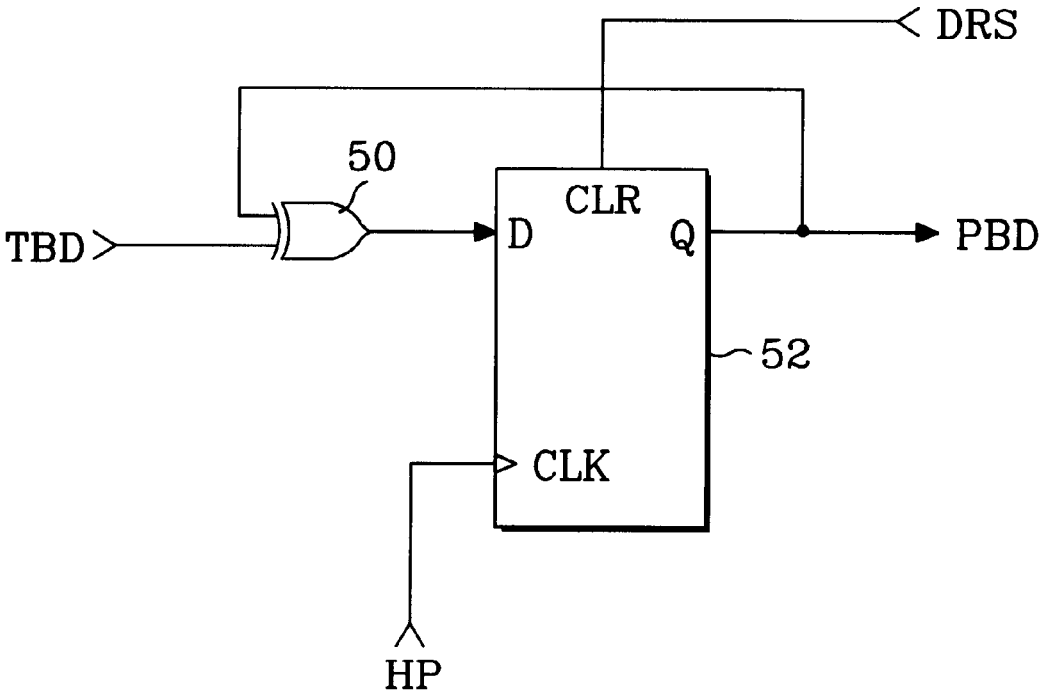
FIG. 3 is a detailed circuit diagram of a data reconstructing unit included in the bit reconstruction unit array shown in FIG. 2.

FIG. 3 is a detailed circuit diagram of the data reconstruction units of the bit reconstruction unit array shown in FIG. 2. In FIG. 3, the data reconstruction unit includes an exclusive OR gate 50 inputting compared bit data TBD from the shift resistor 44, and a flip-flop 52 having an input terminal D connected to an output terminal of the exclusive OR gate 50. The exclusive OR gate 50 performs an exclusive OR operation on the compared bit data TBD and pixel bit data PBD of the previous line, fed back from an output terminal Q of the flip-flop 52, and applies the operation result to an input terminal D of the flip-flop 52. More specifically, if a logical value of the compared bit data TBD is "0", then the exclusive OR gate 50 applies the pixel bit data PBD from the previous line to the input terminal of the flip-flop 52 as it is. On the other hand, if a logical value of the compared bit data TBD is "1", then the exclusive OR gate 50 inverts the pixel bit data PBD from the previous line and applies the same to the input terminal D of the flip-flop 52. In other words, the exclusive OR gate 50 selectively inverts the pixel bit data PBD to be fed back from the output terminal Q of the flip-flop 52 to the input terminal D thereof in accordance with a logical value of the compared bit data TBD.

The flip-flop 52 selectively responds to a data reset signal DRS applied from the controller 30 in FIG. 2 to its clear terminal CLR to initialize the pixel bit data PBD at the output terminal Q to a logical value of "0". The pixel bit data PBD at the output terminal Q of the flip-flop 52 is initialized to a logical value of "0" when the data reset signal DRS has a low logic level. Also, the flip-flop 52 responds to a line pulse HP to latch a logical signal at the input terminal D into the output terminal Q. A logical signal at the input terminal D of the flip-flop 52 is latched into the output terminal Q every rising edge (or falling edge) of a line pulse. The operation of the flip-flop 52 as described above is just to carry out a function of a 1-bit memory for temporarily storing the previous pixel bit data.

As described above, the data transmission apparatus according to the present invention delivers bit data to be transmitted in the form of a comparison signal indicating whether or not it is identical to the previous bit data, so that it can dramatically lower the frequency (i.e., the frequency of logic changes) of a data file in which data having the same logical value appears several to tens of times consecutively in the horizontal and vertical direction. Accordingly, the data transmission apparatus according to the present invention can minimize the power consumption and the EMI.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. For instance, it should be understood that the data transmission line between the controller and the D-IC chip as shown in FIG. 2 has been described as an embodiment of the present invention, but the present invention is applicable to a transmission line between the graphic card within the computer main body and the controller as well as a data transmission line between the graphic card and the D-IC chip. Accordingly, the scope of the invention shall be determined only by the appended claims and their equivalents.

What is claimed is:

1. A data transmission apparatus for a display, comprising:

a controller supplying pixel data comprising a plurality of bits;

a data substitution unit receiving the pixel data, generating pixel representation data from the pixel data, and transmitting the generated pixel representation data over a data bus, wherein each bit of the pixel representation data has a first logical value if a bit of a currently supplied pixel data and a bit of a previously supplied pixel data are the same, and wherein each bit of the pixel representation data has a second logical value if the bit of the currently supplied pixel data and the bit of the previously supplied pixel data are different; and an integrated circuit connected to said data bus receiving the transmitted pixel representation data, reconstructing the pixel data from said received pixel representation data, converting the pixel data to analog pixel data, and supplying the analog pixel data to the display.

2. The data transmission apparatus of claim 1, wherein the integrated circuit is a data driver integrated circuit for driving data lines of the display.

3. The data transmission apparatus of claim 1, wherein the data substitution unit comprises:

delay means for delaying the pixel data at least one bit interval; and bit substitution means receiving the pixel data from the controller and the delayed pixel data from the delay means and substituting the pixel data with the pixel representation data.

4. The data transmission apparatus according to claim 3, wherein said delay means is a line memory.

5. The data transmission apparatus according to claim 4, wherein the line memory stores one line of pixel data.

6. The data transmission apparatus according to claim 4, wherein the line memory is a shift register.

7. The data transmission apparatus according to claim 3, wherein said bit substitution means is an exclusive-OR gate.

8. The data transmission apparatus according to claim 1, wherein the data driver integrated circuit comprises:

a shift register for receiving and shifting the pixel representation data via the data bus; and a bit reconstruction unit array for receiving the shifted pixel representation data and for reconstructing the pixel data therefrom.

9. The data transmission apparatus according to claim 8, wherein the data diver integrated circuit further comprises a digital to-analog converter array for converting the pixel data to the analog pixel data.

10. The data transmission apparatus according to claim 8, wherein the bit reconstruction unit array comprises a plurality of bit reconstruction units.

11. The data transmission apparatus according to claim 10, wherein each bit reconstruction unit comprises:

an exclusive-OR gate; and a flip-flop, wherein the exclusive-OR gate receives one bit of the shifted pixel representation data and an output bit from an output terminal of the flip-flop and provides an exclusive-OR output to an input terminal of the flip-flop, and wherein the flip-flop responds to a line pulse signal to latch the exclusive-OR output at the input terminal thereof the output terminal thereof.

12. A method of transmitting pixel data for a display, comprising:

generating pixel representation data from said pixel data, wherein each bit of said pixel representation data has a first logical value if a bit of a currently supplied pixel data and a bit of a previously supplied pixel data are the same, and wherein each bit of said pixel representation data has a second logical value if the bit of the currently supplied pixel data and the bit of the previously supplied pixel data are different;

transmitting the pixel representation data along a data bus;

receiving said pixel representation data from said data bus;

reconstructing the pixel data from the pixel representation data; and supplying the pixel data to the display.

13. The method of claim 12, wherein generating the pixel representation data comprises:

delaying the pixel data at least one bit interval; and substituting the pixel data with the pixel representation data.

14. The method of claim 13, wherein substituting the pixel data with the pixel representation data comprises performing an exclusive-OR function on the pixel data and the delayed pixel data.

15. The method of claim 12, wherein reconstructing the pixel data from the pixel representation data comprises:

delaying the pixel representation data by at least one bit interval; and performing an exclusive-OR function on the pixel representation data and the delayed pixel representation data.

16. The method of claim 12, wherein supplying the pixel data to the display further comprises:

converting the pixel data to analog pixel data; and supplying the analog pixel data to the display.

17. The method of claim 12, wherein the pixel representation data is received from the data bus by a data driver integrated circuit for driving data lines in the display.

18. A driver for a display, comprising:

a controller supplying pixel data comprising a plurality of bits;

a data substitution unit receiving the pixel data and transmitting pixel representation data, wherein each bit of the pixel representation data has a first logical value if a bit of a currently supplied pixel data and a bit of a previously supplied pixel data are the same, and wherein each bit of the pixel representation data has a second logical value if the bit of the currently supplied pixel data and the bit of the previously supplied pixel data are different; and an integrated circuit connected to said data substitution unit and receiving the pixel representation data via a data bus, reconstructing the pixel data, converting the pixel data to analog pixel data, and supplying the analog pixel data to the display, wherein the data driver integrated circuit comprises:

a shift register for receiving and shifting the pixel representation data via to data bus; and a bit reconstruction unit array for receiving the shifted pixel representation data and for reconstructing the pixel data therefrom, wherein each bit reconstruction unit comprises:

an exclusive-OR gate; and a flip-flop, wherein the exclusive-OR gate receives one bit of shifted pixel representation data and an output bit from an output terminal of the flip-flop and provides an exclusive-OR output to an input terminal of the flip-flop, and wherein the flip-flop responds to a line pulse signal to latch the exclusive-OR output at the input terminal thereof to the output terminal thereof.

19. The data transmission apparatus according to claim 1, wherein the first logical value is "0" and the second logical value is "1".

20. The method of claim 12, wherein the first logical value is "0" and the second logical value in "1".

21. The driver according to claim 18, wherein the first logical value is "0" and the second logical value is "1".

22. A method of driving a liquid crystal display (LCD) panel, comprising:

supplying pixel data including a plurality of bits;

comparing each bit within the supplied pixel data to a bit within a previously supplied pixel data;

transmitting a compared bit data signal including a plurality of bits over a data bus, wherein each bit of the compared bit data signal has logical values based on the comparing including:

a first logical value when a bit of the currently supplied pixel data and a bit of a previously supplied pixel data are the same; and a second logical value when the bit of the currently supplied pixel data and the bit of the previously supplied pixel data are different;

receiving the compared bit data signal over the data bus; and applying a pixel signal to the LCD panel based on the received compared bit data signal, wherein a pixel signal corresponding to the previously supplied pixel data is applied to the LCD panel when a bit of the compared bit data signal includes the first logical value; and a pixel signal corresponding to the currently supplied pixel data is applied to the LCD panel when a bit of the compared bit data signal includes the second logical value.

* * * * *